United States Patent [19]

Erickson

[11] 4,011,796

[45] Mar. 15, 1977

[54] RADIAL HYDRAULIC PUMP OR MOTOR WITH IMPROVED PISTONS AND SLIPPERS

[76] Inventor: Lewis C. Erickson, 3328 E. Superior St., Duluth, Minn. 55804

[22] Filed: Jan. 16, 1975

[21] Appl. No.: 541,401

[52] U.S. Cl. ..... 91/488; 91/495

[51] Int. Cl.[2] ..... F01B 13/06

[58] Field of Search ..... 91/494–496, 91/488; 417/273

[56] References Cited

UNITED STATES PATENTS

| | | | |
|---|---|---|---|
| 1,090,235 | 3/1914 | Rogers | 417/273 |
| 1,633,720 | 6/1927 | Wilsey | 91/496 |
| 1,778,238 | 10/1930 | Wilsey | 91/488 |
| 1,974,961 | 9/1934 | Johnson | 91/496 |
| 2,309,551 | 1/1943 | Trapp et al. | 417/273 |
| 2,621,607 | 12/1952 | Trapp | 417/273 |

FOREIGN PATENTS OR APPLICATIONS

| | | | |
|---|---|---|---|
| 1,132,001 | 10/1968 | United Kingdom | 91/487 |
| 1,030,170 | 5/1966 | United Kingdom | 91/495 |

*Primary Examiner*—William L. Freeh
*Attorney, Agent, or Firm*—Schroeder, Siegfried, Ryan & Vidas

[57] ABSTRACT

A fluid pump or motor is disclosed having a housing with a central opening in one side thereof and containing fluid inlet and outlet ports in which one portion of the housing includes a slipper bearing formed in the end opposite the central opening where the axes of the slipper bearing and central opening are in eccentric alignment with a shaft rotatably supported within the central opening of the housing where piston means for operating in a cylinder has the end nearest the center of the shaft with a segment of circular cross-section slot formed therein, the axis of which is parallel to the axis of the shaft with a slipper of substantially circular cross-section nested in the slot of each piston with the slipper extending beyond the walls of each piston in reduced radial configuration and working with a rotor having a plurality of radially arranged cylinders, each cylinder having a port at the outer end thereof and having the walls of each cylinder nearest the center of the rotor containing a dome shaped void to accommodate the upper portion of the slipper permitting the corresponding piston therein to extend into the cylinder beyond its lower edge where the rotor is fixedly secured to the shaft with a radial valve having a first part secured to the housing means and communicating with the inlet and outlet ports and having a secondpart formed within the rotor which has a plurality of conduits communicating respectively with each cylinder port with a pair of retaining rings secured over the outer radial surface of that portion of each slipper extending beyond the walls of each piston.

7 Claims, 7 Drawing Figures

50
41
100
101
40
23
24
80
90
97
95
58
34
25
1
93
92
70
57
96
35
36
98
94
20
60
42
26
43
27
21
37
31
32
33
22
30
91

RADIAL HYDRAULIC PUMP OR MOTOR WITH IMPROVED PISTONS AND SLIPPERS

This invention relates to the field of hydraulic pumps and motors and more particularly to hydraulic pumps with radially oriented pistons and cylinders.

Conventional axial piston pumps create substantial bending loads and consequently extreme bearing loads between the piston and its bore. This particular bending action is true at all points of rotation since the slipper angle is constant and the weight of the pistons and consequent centrifugal force is always acting on the piston bores to create a further frictional loss. Because of these factors, a high mechanical loss is generally created when compared with radial piston design for hydraulic pumps.

The general state of the art relative to radial pumps has also met with numerous disadvantages. For instance, the speed of radial pumps is generally limited and as a consequence, the pressures are also limited so that a practical pump is not always attainable. Keeping in mind that the centrifugal forces are greater as the piston moves away from the center of the shaft to which it is connected, the present embodiment brings the piston to its lowest possible configuration in combination with a slipper so that the centrifugal forces are greatly reduced. Because of the piston and slipper design, most pumps have a piston offset that is more than needed and thus the pistons remain at a radius further from the center of the pump than is actually needed.

The present invention discloses a combination of the slipper bearing surface, slippers, slipper retaining rings and pistons in such a configuration as to form this unique pump mechanism. The slipper bearing surface, slippers, slipper retaining rings and pistons rotate as an assembly about a center independent from the rotor assembly and remain in good dynamic balance regardless of the degree of offset between the centers of the piston assemblies in the rotor assembly. Varying the degree of offset of the pistons in this invention has little effect on overall dynamic balance of the pump. The pistons simply do not reciprocate except in their relationship to the rotor which is in contrast to the axial piston pump where the pistons do reciprocate to cause a major loss in mechanical efficiency.

It is therefore a general object of the present invention to provide a fluid pump or motor in which the slipper bearing surface, slippers, slipper retaining rings and pistons are in good dynamic balance.

It is still a further object of the present invention to provide a radial pump with a minimum amount of offset between the pistons.

It is still a further object of the present invention to provide cylinders which are cut away to permit the pistons to extend fully into the cylinders with a minimum amount of side loading.

It is yet another object of the present invention to provide a radial pump where when a piston moves from suction to compression, the pistons are at zero eccentricity to the slipper bearing.

It is still a further object of the present invention to use a thin walled piston to reduce the center of gravity and consequently the centrifugal force on the piston.

It is still a further object of the present invention to utilize a radial valve means for a bearing to create a hydrostatic balance within the pump.

It is still a further object of the present invention to provide a slipper bearing surface which is displaceable in an arc to create a variable and reversible radial pump.

These and other objects and advantages of the invention will more fully appear from the following description, made in connection with the accompanying drawings, wherein like reference characters refer to the same or similar parts throughout the several views, and in which.

Figure 3:
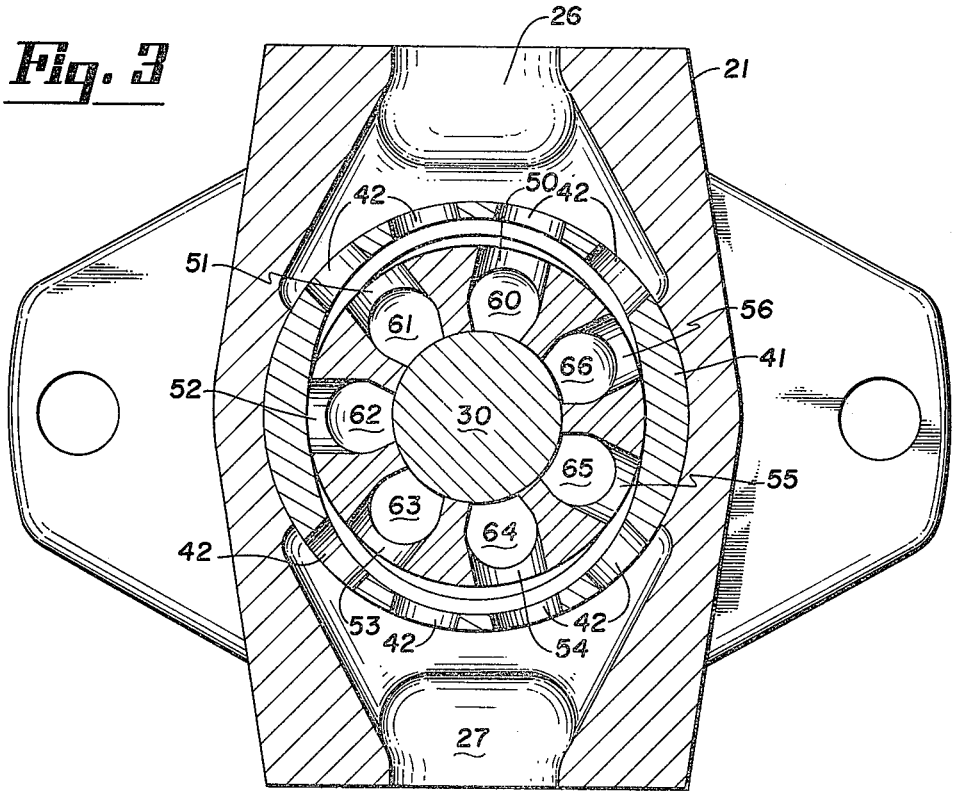
FIG. 3 is a sectional view of a valve bearing taken along lines 3—3 of FIG. 2.
Figures 2, 3A, 4:
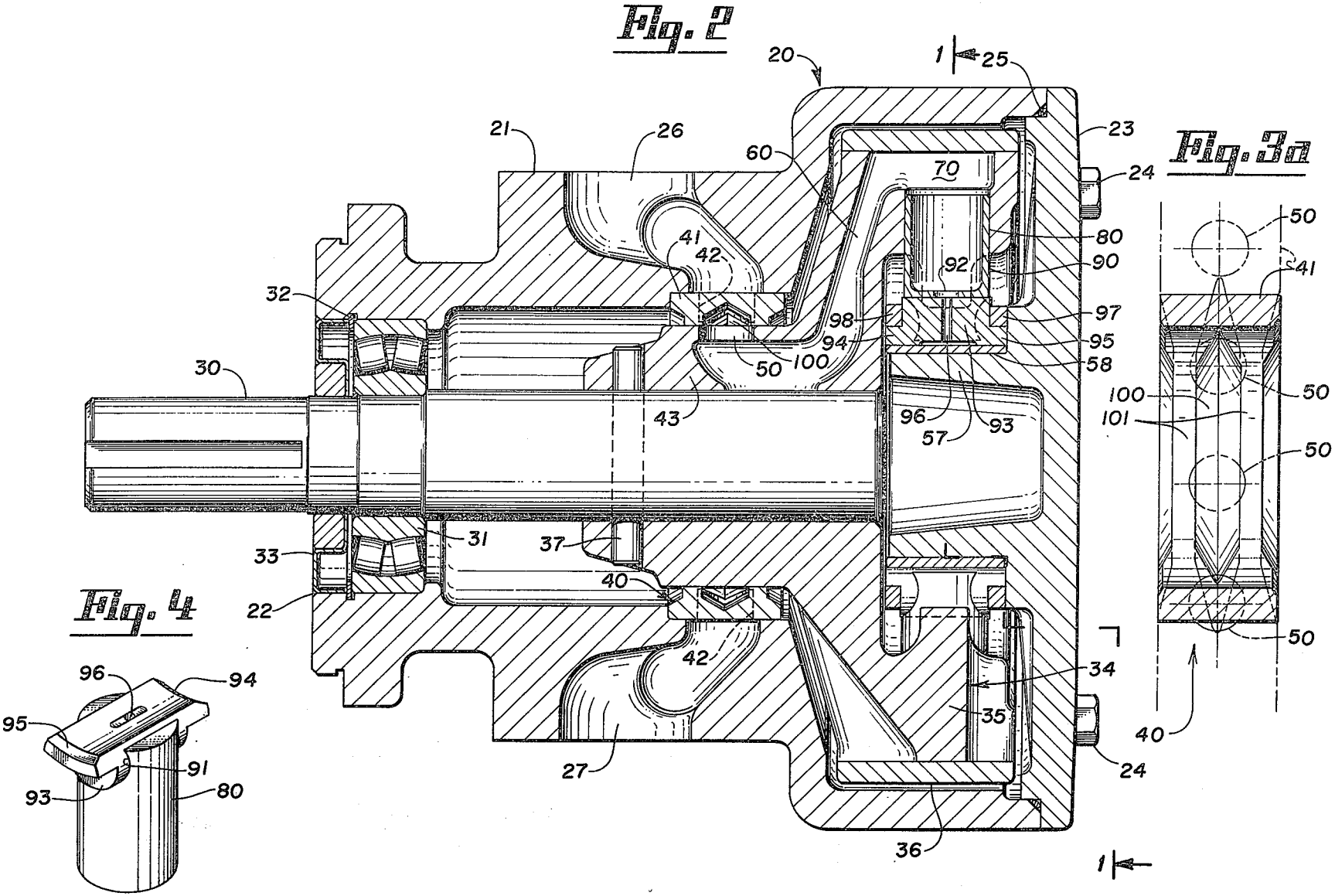
FIG. 2 is a sectional view of a fixed displacement pump.
Figure 6:
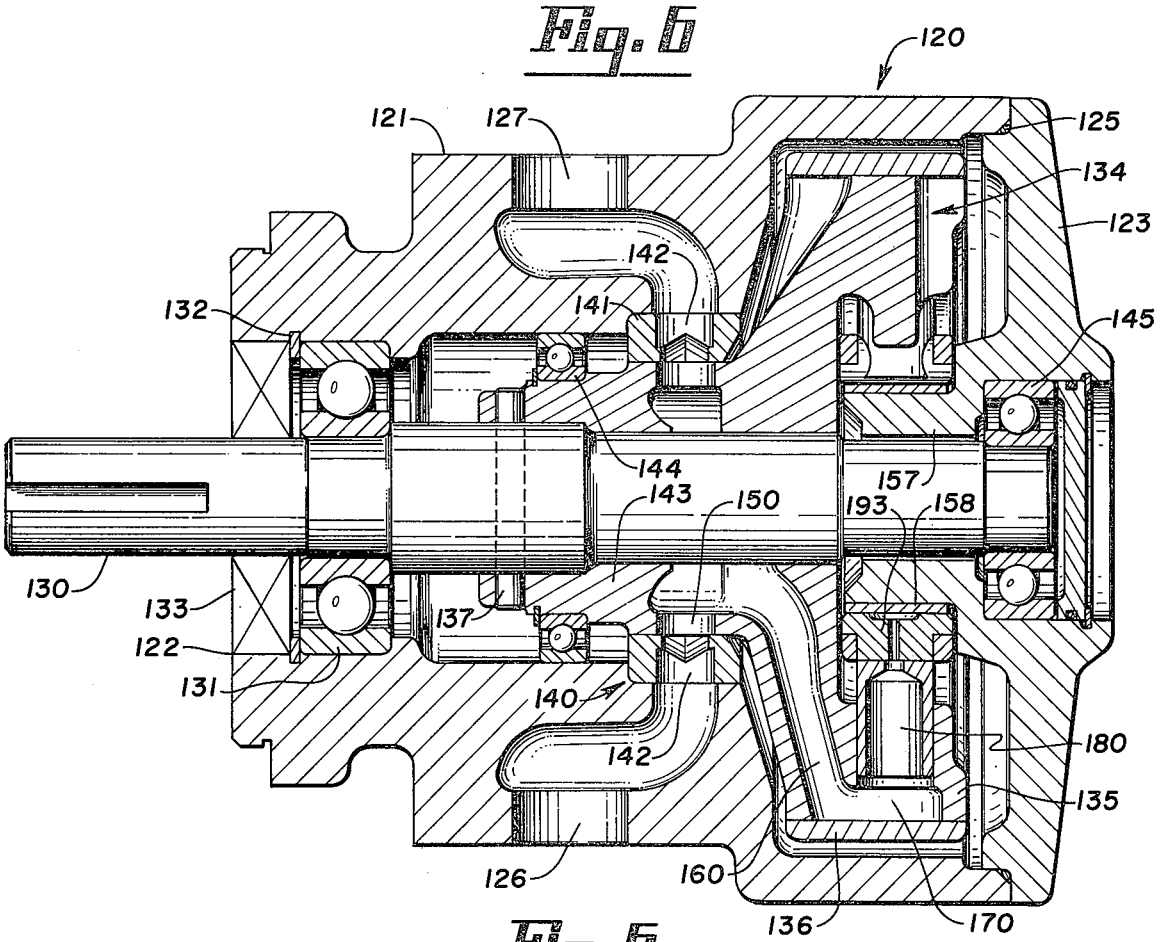
Figure 5:
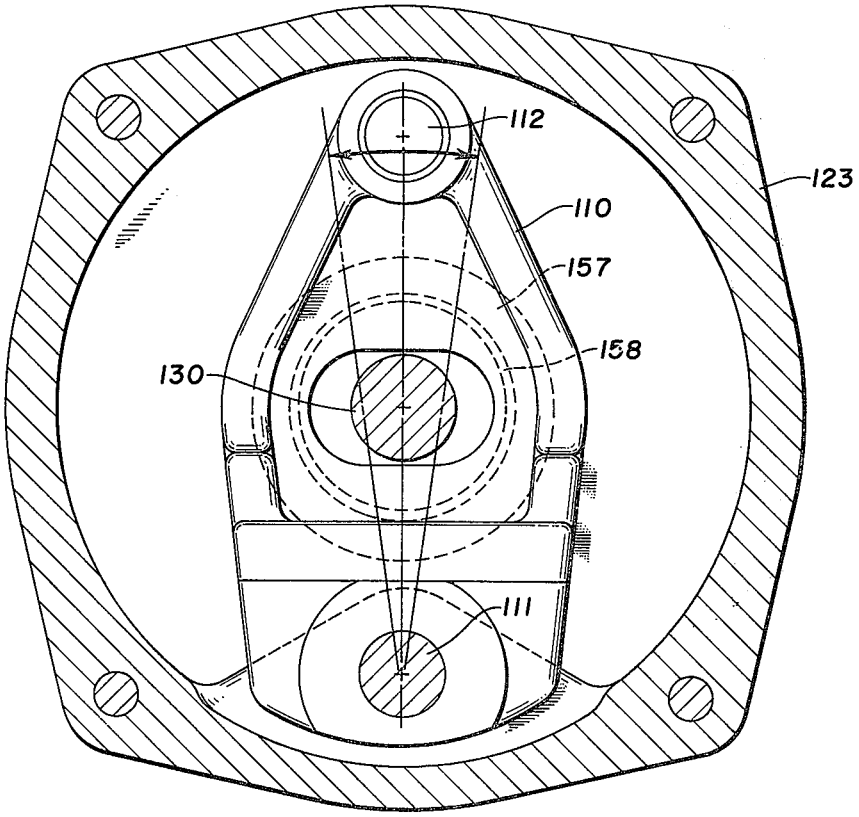

FIG. 3*a* is a diagrammatic view of the projected area of the bearing as shown in FIG. 3;

FIG. 4 is a perspective view of a piston and slipper;

FIG. 5 is a sectional end view of a variable displacement pump showing a displacement control; and FIG. 6 is a section of an alternate fixed displacement pump with alternate shaft and rotor support.

Figure 1:
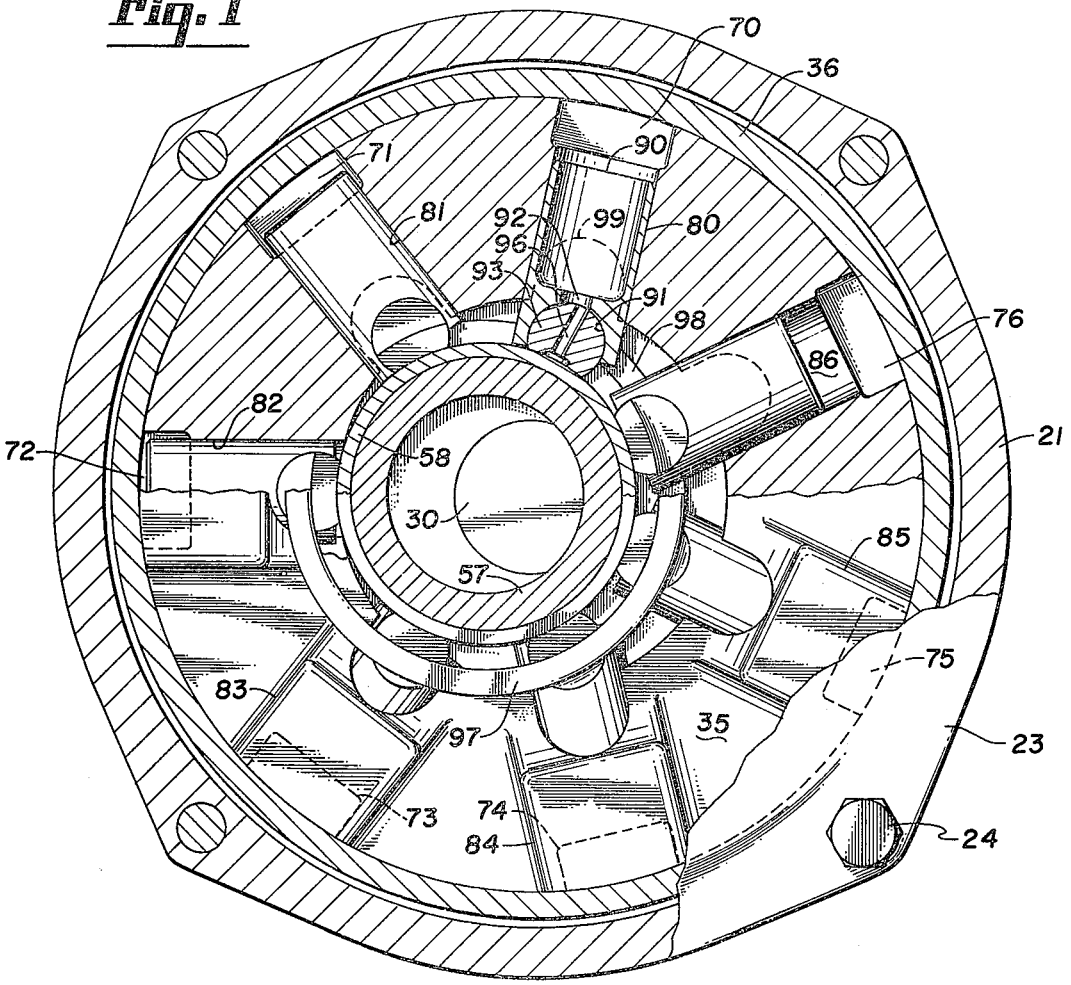
FIG. 1 is a partial elevation section taken along lines 1—1 of FIG. 2 with portions cut away.

Referring now to FIGS. 1, 2 and 3, there is disclosed a radial piston pump 20 having a housing formed of a first member 2 which has a central opening 22 formed in the end thereof. A second housing member 23 is secured to housing member 21 with suitable means such as machine bolts 24 and a sealing ring 25 seals members 21 and 23 in fluid sealing relationship. Housing 21 contains a pair of fluid ports 26 and 27.

A shaft 30 is disposed within the central opening 22 and housing member 21 and is rotatably supported by a bearing 31 which is secured within housing member 21 by an internal retaining ring 32 which is seated in a cooperating internal annular groove formed in central opening 22. An oil seal 33 is secured in front of retaining ring 32 and seals housing member 21 with respect to shaft 30. A rotor 34 is formed from a first member 35 and a ring member 36, rotor member 34 being secured to shaft 30 by means of a pin 37.

A radial valve 40 is formed from an annular ring 41 which has a plurality of bores 42 formed therein is secured in housing member 21 in fluid communication with ports 26 and 27. A second radial member 43 is formed from a portion of rotor member 45 and for the embodiment shown, contains seven ports, 50 through 56.

A slipper bearing support member 57 is formed as part of housing member 23 and extends axially within housing member 21 but the axes of slipper bearing member 57 and the shaft axes are in eccentric alignment. That is, the bearing support member is offset from the axis or central opening in housing member 21. A bearing 58 is fitted over bearing support member 57 and for some applications, it may be desirable to merely hard finish the bearing support member to use it as a bearing member instead of securing a bearing to it.

Seven fluid conduits 60 through 66 communicate respectively with ports 50 through 56 and are in further communication with seven cylinder ports 70 through 76. Seven cylinders 80 through 86 respectively communicate with cylinder ports 70 through 76.

Cylinder 80 will be described in more detail, keeping in mind that each of the other cylinders and associated mechanism will be identical for each of the cylinders. A thin walled piston 90 is disposed within cylinder 80 and the end nearest bearing 58 has a slot 91 formed therein which is of a circular cross-section segment of over 180°. The cup shaped piston 90 has a small bore 92 formed in the bottom of the cavity which communicates with the circular cross-section slot 91. A slipper 93 is formed in a substantially circular cross-section and is nested in circular slot 91. Slipper 93 extends beyond the edge of the walls of each piston in reduced radial configuration and is identified as numerals 94 and 95. A small bore 96 is formed centrally through slipper 93 to communicate with bore 92 formed in piston 90. Each of the slippers 93 is held in place against bearing 58 and prevented from axial movement through the use of a pair of retaining rings 97 and 98 which are secured over the outer radial surface of that portion of each slipper extending beyond the walls of each piston. It will also be observed that cylinder 80 has a dome shaped void 99 formed at the bottom of the cylinder to accommodate the upper portion of slipper 93 thus permitting piston 90 to extend into cylinder 80 beyond its lower edge which is best seen at the location of cylinder 82. It will also be observed that the lower portion of slipper 93 has a segment removed which is of the same radius as bearing 58. It has also been found possible to make the stroke of the piston approximately the same as its diameter.

With the design of the piston and slipper, lubrication is provided through the use of the oil under pressure escaping along the walls of the piston and cylinder as well as through bores 92 and 96 to provide a proper bearing film between the piston and slipper. By keeping the slipper contained within the very end section of the piston, the centrifugal forces are reduced considerably and this is accomplished by permitting the slipper to move into the dome shaped void cut in the edge of the cylinder walls. It will also be observed that the pistons extending from cylinders 86 and 85 are shown in almost touching relationship and thus the diameter of the whole pump is determined by the distance the pistons may travel radially inward in their operation. With that arrangement, the maximum offset is achieved and thus the mass is maintained closer to the center of the pump. It will also be observed that in FIG. 1, the left-hand bottom portion of piston 90 has a slight clearance with bearing 58 which also is a factor in determining the offset of the pistons. It will also be observed in FIG. 2 that there is very little lateral side wall thrust on piston 90 as it moves into cylinder 80 and that from FIG. 1, it will be observed that there is good side wall support for the piston inasmuch as the cylinder side walls at all times supports at least one-half of the side wall surfaces of the piston in its most extended position such as shown in cylinder 86. By using a imaginary line through bore 96 of slipper 93, it will be observed that as slipper 93 moves around bearing 58, the angle of the force is substantially directed along the piston axis and in the worst condition which is probably that shown for cylinder 80, the lines of force are oriented within the diameter of piston 90. With these improvements, the radial pump may be operated at higher speeds because the mass of the pistons remains closer to the center of the pump than that which is presently being used in the prior art. To further increase the efficiency of the pump, an anti-friction bearing may be used to replace bearing 58 and thus the sliding friction which would normally be encountered between slipper 93 and bearing 58 would be substantially reduced by having the slippers bear against a surface which is also rotating.

In viewing FIG. 1, and assuming a reference line through cylinder 82 as a horizontal line and any line drawn perpendicular thereto as a vertical line, the invention provides a relationship between ball bearing 58 and the pistons such that there is a hydrostatic load achieved between the rotor at the pistons and the bearing load. Assumimg a counter-clockwise rotation of the rotor and using the offset as dislcosed in FIG. 1, it will be seen that a piston loading occurs above the horizontal center lines. The sum of the piston thrusts would be downward with respect to the slipper bearing 58 and equal and opposite to that of the rotor and the load may be assumed for these purposes to be approximately 4,600 pounds with a pressure of 3,000 psi. Referring to FIG. 2, this load, when measured at the valve bearing, is approximately 7,600 pounds due to the relationship between the piston, the valve bearing location, and bearing 31. In FIG. 3*a*, the projected area of the bearing for complete balance should equal the open area 100 which has fluid under pressure at 3,000 psi plus the general bearing area 101 carrying an approximate average pressure of 1,500 psi. However, it is desirable to have a degree of vertical unbalance (as seen in FIG. 2) to create a journal bearing effect on the pressure side of the bearing and control oil film thickness and consequent hydraulic losses. Assuming a minimum bearing fit, it is desirable to have an under balance thus creating a journal bearing and reducing oil film thickness to a minimum at the pressure side of the valve.

The oil film thickness, however, is not constant in a round bearing but is only true at the point of maximum bearing pressure and the point of maximum bearing pressure is at the top of FIG. 3. The side bearing areas have little effect on the total bearing projected area (FIG. 3*a*) but when the bearing area itself is projected as shown with port 50 shown in four transient positions, the side areas of maximum film thickness offer the longest path of oil flow wich may be accomplished within the bearing by plunge-milling or by a sweep tool to the desired contours.

In some instances, it may be desirable to have the shaft supported not only by bearing 31 and the valve bearing 40 but also at alternate locations (FIG. 6) where the pump is to be operated at extremely high pressures or high speed or over a heavy duty cycle in which wear may inevitably occur in valve bearing 40. An alternate embodiment is shown in FIG. 6 in which all of the like parts as found in FIG. 2 are designated with a numeral having "100" added to the numeral. In addition to those elements of the pump found in FIGS. 1 and 2, an anti-friction bearing 144 is secured between housing member 121 and the reduced section of rotor 134. Anti-friction bearing 144 is placed adjacent to the valve bearing 140 for reasons which will be described subsequently. Alternately the other end of shaft 130 may be supported by another anti-friction bearing 145.

The same bearing requirements as that discussed previously with respect to valve bearing 40 are also applicable with respect to the embodiment shown in FIG. 6 in that the anti-friction bearing 144 or 145 would have a required capacity of the amount of under balance designed into the valve bearing to provide and control a minimum oil-film on the pressure side to minimize leakage. Bearing 144 or 145 may also be used to limit the amount of wear or gap that may occur between the rotor and stationary portion of the valve bearing 140 by taking up the load upon a limited amount of wear in the bearing.

Of course bearing 144 may also be eliminated and in some configurations the bending applied to shaft 130 may be controlled by bearings 131 and 145 to permit the valve bearing 140 to function properly. Under these conditions, bearing 145 would have internal and/or a fit clearance to limit the offset of the rotor and consequent wear and clearance of valve bearing 140.

In fact, FIG. 6 may be altered even further by using a centrifugal charging pump within the forward portion of the standard pump body. Using the centrifugal charging pump would improve the overall pump's internal porting considerations and minimize the required porting 170 in the rotor. Through the use of a centrifugal charging pump, there would be no internal changes required to reverse the pump flow for a given shaft rotation since rotating the case member 123 would reverse the flow and that would be all that is required.

It may also be desirable to provide a pump which has a variable displacement as well as a change of pressure direction and in FIG. 5, there is shown a modified version of FIG. 6 in which the end cap 123 has been cut away to disclose a yoke member 110 which carries slipper bearing support 157 and bearing 158. Yoke 110 is pivotally supported at the bottom about a post 111 and is rotatable about post 111 clockwise or counterclockwise where a control arm 112 at the top of the yoke is used to secure the yoke in place. Through this arrangement, the slipper bearing may be moved through a small arc to produce a slight displacement of the pistons with respect to the slipper bearing and thus produce a low volume pump. Where it is desirable to increase the volume in the pump, yoke 110 is moved further from the central position. It is also possible to vary the direction of the pump by moving yoke 110 in the opposite direction and thus reversing the direction of the cylinders to change from that of compression to suction.

Basic to all of the different embodiments shown is the close configuration of the pistons allowed by the slipper configuration. Through bringing the piston closer to the center of the unit, the lateral loadings and the radial loadings on the piston are reduced to a negligible amount.

It will, of course, be understood that various changes may be made in the form, details, arrangement and proportions of the parts without departing from the scope of the invention which consists of the matter shown and described herein and set forth in the appended claims.

What is claimed is:

1. A fluid pump or motor comprising:

a. housing means having a central opening in one side thereof and having fluid inlet and outlet ports therein, said housing means having slipper bearing means formed in the end thereof opposite said central opening, the axes of said slipper bearing means and the central opening being eccentrically aligned;

b. shaft means rotatably supported within the central opening of said housing means;

c. piston means for operating in a cylinder, the end portion nearest the axis of said shaft having a slot formed therein of circular cross-section segment exceeding 180°, the axis of which is parallel to that of said shaft means;

d. a slipper of substantially circular cross-section nested in each slot of each piston means, said slipper extending beyond the walls of each piston in reduced and equal radial configuration;

e. a pair of retaining rings secured over the outer radial surface of that portion of each slipper extending beyond the walls of each piston means;

f. rotor means having a plurality of radially arranged cylinders, each cylinder having a port at the outer end thereof, and having the walls of each cylinder nearest the center of said rotor means being cut away to allow clearance for said slipper and piston means assembly to the degree said piston means is entirely contained within said cylinder at its maximum point of eccentricity, said rotor means being fixedly secured to said shaft;

g. and radial valve means having a first part secured to said housing means and communicating with said inlet and outlet ports and having a second part formed in said rotor means with a plurality of conduits and ports communicating respectively with each cylinder port.

2. The structure set forth in claim 1 wherein said piston means and said slipper each have a central bore formed therein communicating with each other permitting fluid flow therethrough.

3. The structure of claim 1 wherein said radial valve means forms a bearing for said rotor and shaft means assembly.

4. The structure of claim 1 including:

a yoke mechanism carrying said slipper bearing means and being movably secured to said housing means, said yoke mechanism including means securing the same with respect to said housing means.

5. The structure set forth in claim 1 wherein said radial valve means is constructed and arranged in the form of a ported bearing comprising:

a stationary radial outer member within said housing means and having a predetermined open area formed therein for receiving hydraulic fluid under pressure, bordered by journal bearing areas adjacent said open area;

and a rotatable inner member formed in said rotor means having a plurality of ports therein communicating with said open area of said radial outer member and having portions of said rotor means communicating with said journal bearing areas of said radical outer member, the load unbalance in the direction of the high pressure side of said pump between said open area and said wall members producing a radial loading at said ported bearing due to the mechanical couple which is slightly less than the loading at said pistons resulting in a substantially hydrostatic balance across said shaft means and close fitting radial valve means.

6. In a fluid radial pump or motor, the combination comprising:

a. a plurality of radially arranged pistons, each of which has a cross-bore of circular cross-section segment exceeding 180° contained in its most central end thereof, the axis of which is normal to the radius of piston alignment;

b. a plurality of slippers, each of which is contained in said piston cross-bore in rotating relationship and extends beyond said piston diameter providing a first pair of constant radius circumferential slipper bearing surfaces and a second circumferential bearing surface;

c. a bearing member having a circumferential bearing surface with a circumference substantially the same as said second circumferential bearing surface of said slippers, the axis of said bearing member surface being eccentrically disposed with respect to the axis of each cross-bore in said plurality of pistons;

d. a rotor mounted eccentrically with respect to said bearing member having an axial bore with a plurality of radially arranged cylinders communicating therewith, said axial bore having a radius no greater than that required to permit clearance of said bearing member circumferential surface at its point of maximum eccentricity, each of said cylinders being cut away to allow clearance for said corresponding slipper and piston assembly, but retaining maximum sidewall support to the degree that said piston is entirely contained within said rotor beyond said axial bore at its maximum point of eccentricity;

e. and a pair of rings riding on the first pair of circumferential slipper bearing surfaces securing said slipper and piston against radial outward movement and causing said second circumferential bearing surface of each slipper to engage said circumferential surface of said bearing member.

7. The structure set forth in claim 6 wherein each of said plurality of pistons has said cross-bore disposed at a predetermined location from the inner end thereof permitting the inward extension of said piston beyond the center line of said cross-bore in minimum clearance with said circumferential surface of said bearing member and the adjacent pistons when fully extended.

* * * * *